US009402782B2

(12) United States Patent
Browne

(10) Patent No.: US 9,402,782 B2
(45) Date of Patent: Aug. 2, 2016

(54) PACKAGE WITH TAMPER-EVIDENT FEATURES

(71) Applicant: GE HEALTHCARE AS, Oslo (NO)

(72) Inventor: Martin Monteagle Browne, Oslo (NO)

(73) Assignee: GE HEALTHCARE AS, Oslo (NO)

( * ) Notice: Subject to any disclaimer, the term of this patent is extended or adjusted under 35 U.S.C. 154(b) by 0 days.

(21) Appl. No.: 14/364,377

(22) PCT Filed: Dec. 14, 2012

(86) PCT No.: PCT/EP2012/075491
§ 371 (c)(1),
(2) Date: Jun. 11, 2014

(87) PCT Pub. No.: WO2013/087817
PCT Pub. Date: Jun. 20, 2013

(65) Prior Publication Data

US 2014/0299568 A1 Oct. 9, 2014

(30) Foreign Application Priority Data

Dec. 15, 2011 (EP) ..... 11193737

(51) Int. Cl.
*A61J 1/00* (2006.01)
*A61J 1/20* (2006.01)
(Continued)

(52) U.S. Cl.
CPC *A61J 1/00* (2013.01); *A61J 1/2096* (2013.01); *B65B 3/003* (2013.01); *B65B 7/161* (2013.01);
(Continued)

(58) Field of Classification Search
CPC ..... A61J 1/05; A61J 1/14; A61J 1/20; A61J 2001/2003; A61J 2001/2006; A61J 2001/201; A61J 1/18; A61J 1/2068; A61J 1/00; A61J 1/2096; A61J 1/1425; A61J 1/1481; A61J 1/202; A61J 1/1412; A61J 1/2024; A61J 1/2041; A61J 1/2075; B65D 51/24; B65D 51/20; B65D 51/18; B65D 55/024; B65D 55/02; B65D 41/46; B65D 41/32; B65D 41/62; B65B 3/00; B65B 7/161; B65B 7/2871; B65B 7/2842
USPC ..... 215/364, 355, 247, 251, 250; 220/789, 220/787, 784, 212, 801, 800, 799, 796, 265
See application file for complete search history.

(56) References Cited

U.S. PATENT DOCUMENTS 3,071,274 A * 1/1963 Ravn ..... B65D 51/002 215/249
4,231,486 A * 11/1980 Bock ..... 220/266
(Continued)

FOREIGN PATENT DOCUMENTS

CN 107654 A 10/1993
CN 1083011 A 3/1994
(Continued)

OTHER PUBLICATIONS

Translation of DE1228028 (JACOB) Nov. 3, 1966, pp. 1 and 7.*
(Continued)

*Primary Examiner* — Robert J Hicks

(57) ABSTRACT

The present invention relates to a package, and more particularly to a package for sterile fluids, such as contrast media. More particularly the invention relates to a package comprising a container, a connecting plug and a cap. The package hence includes an integrated connection for easily transferring the content of the container of the package, e.g. to a syringe, a tube or a cartridge.

22 Claims, 8 Drawing Sheets

(51) Int. Cl.

| | |
|---|---|
| ***B65B 3/00*** | (2006.01) |
| ***B65B 7/16*** | (2006.01) |
| ***B65B 7/28*** | (2006.01) |
| *A61J 1/18* | (2006.01) |

(52) U.S. Cl.

CPC ..... *B65B 7/2871* (2013.01); *A61J 1/1425* (2015.05); *A61J 1/1481* (2015.05); *A61J 1/18* (2013.01); *A61J 1/202* (2015.05); *A61J 1/2024* (2015.05); *A61J 1/2041* (2015.05); *A61J 1/2075* (2015.05)

(56) References Cited

U.S. PATENT DOCUMENTS

| | | | | |
|---|---|---|---|---|
| 4,366,912 | A | 1/1983 | Matukura et al. | |
| 5,080,245 | A * | 1/1992 | Conard | B65D 51/002 215/249 |
| 5,454,805 | A | 10/1995 | Brony | |
| 5,555,988 | A * | 9/1996 | Koch | B65D 51/002 215/249 |
| 5,718,348 | A | 2/1998 | Manera | |
| 5,902,298 | A | 5/1999 | Niedospial | |
| 6,692,478 | B1 | 2/2004 | Paradis | |
| 6,868,978 | B2 * | 3/2005 | Amschlinger et al. | 215/249 |
| 2002/0121496 | A1 | 9/2002 | Thiebault et al. | |
| 2003/0029828 | A1 | 2/2003 | Amschlinger et al. | |
| 2009/0166311 | A1 | 7/2009 | Claessens | |
| 2014/0217099 | A1 | 8/2014 | Browne | |
| 2014/0299568 | A1 | 10/2014 | Browne | |

FOREIGN PATENT DOCUMENTS

| | | | |
|---|---|---|---|
| CN | 1155265 | A | 7/1997 |
| CN | 1250365 | A | 4/2000 |
| CN | 1431967 | A | 7/2003 |
| CN | 103826985 | A | 5/2014 |
| CN | 104105468 | A | 10/2014 |
| DE | 1228028 | | 11/1966 |
| DE | 3519655 | A1 | 12/1986 |
| DE | 4204427 | C1 | 7/1993 |
| DE | 4428434 | A1 | 2/1996 |
| EP | 0291658 | A1 | 11/1988 |
| EP | 0624527 | A1 | 11/1994 |
| EP | 0761562 | | 3/1997 |
| EP | 1707500 | | 10/2006 |
| FR | 2355730 | A1 | 1/1978 |
| FR | 2625479 | A1 | 7/1989 |
| JP | 2014532405 | A | 12/2014 |
| JP | 2015505698 | A | 2/2015 |
| WO | 9309036 | A1 | 5/1993 |
| WO | 9322210 | A1 | 11/1993 |
| WO | 98/30188 | | 7/1998 |
| WO | 9832411 | A1 | 7/1998 |
| WO | 0160699 | A2 | 8/2001 |
| WO | 2011039004 | | 4/2011 |
| WO | 2013045619 | A1 | 3/2013 |
| WO | 2013062416 | A1 | 5/2013 |
| WO | 2013087817 | A1 | 6/2013 |

OTHER PUBLICATIONS

PCT/EP2012/075491 ISRWO Dated Apr. 4, 2013.

International Search Report and Written Opinion for PCT/US2012/069195, mail date Nov. 28, 2012, 14 pages.

Chinese Office Action for 201280047700.5 dated Feb. 28, 2015 and English Translation of the same, 15 pages.

European Office Action for 12762646.3 dated Apr. 29, 2015, 6 pages.

International Search Report and Written Opinion for PCT/EP2012/069195, mail date Nov. 28, 2012, 7 pages.

Chinese Office Action with English Language Translation regarding Chinese Application No. 201280069734.4, dated Oct. 23, 2015, 19 pages.

* cited by examiner

PACKAGE WITH TAMPER-EVIDENT FEATURES

This application is a filing under 35 U.S.C. 371 of international application number PCT/EP2012/075491, filed Dec. 14, 2012, which claims priority to EP application number 11193737.1 filed Dec. 15, 2011, the entire disclosure of which is hereby incorporated by reference.

FIELD OF THE INVENTION

The present invention relates to a package, and more particularly to a package for sterile fluids, such as contrast media. More particularly the invention relates to a package comprising a container, a connecting plug and a cap. The package includes an integrated connection for easily transferring the content of the container of the package, e.g. to a syringe, a tube or a cartridge.

BACKGROUND OF THE INVENTION

In the medical field, sterile fluids, such as medicaments, pharmaceuticals, sterile saline solution and so on are frequently required. Such sterile fluids are typically supplied in bottles made of glass or plastic bottles, or in semi-collapsible containers.

Bottles for sterile fluids are typically closed by a rubber stopper inserted into the mouth of the bottle. The stopper is designed so that it can be pierced by a needle, an infusion spike, or the like, to allow the contents of the bottle to be withdrawn. In some designs the stopper can be removed to allow the contents of the bottle to be poured out. In order to hold the stopper in place different kinds of over seals exist, such as a cap made of aluminium or similar thin sheet metal being crimped over the stopper and the upper part of the bottle. Over seals can also be made of plastic. In order to gain access to the stopper, either to pierce it or remove it, the cap is either partially or totally torn away. WO00/03920 of the applicant describes an example of a package on the market comprising a plastic bottle, a stopper and a plastic cap. The cap comprises a cover member which supports the stopper and which has a region that is removable to expose the upper surface of the stopper.

When transferring sterile fluids from such known packages to a syringe, cartridge or an infusion pump the stopper is typically pierced with the needle of a syringe, or the fluid is transferred to another container by removing the stopper and pouring out the content or siphoning this out with a straw. The use of a needle always poses a prick risk for the operator, in addition to the risk of transferring small particles from the stopper to the fluid to be injected in a patient. Further, if pouring or siphoning out the content, many operating steps are needed in order to transfer the bottle content to a syringe or a cartridge before the content can be administered to the patient. Some adaptors and transfer sets have been described directed to devices and methods for transferring a fluid from a bottle or vial to a syringe, cartridge or injector. WO2004/103256 discloses a transfer set for transferring e.g. between a container having a pierceable closure or stopper and another container such as a conventional syringe having a Luer threaded connector without a needle cannula. Such a transfer is not directly associated or integrated with the container and may not be practical to handle. U.S. Pat. No. 5,454,805 discloses a link for use between a needleless syringe and a liquid medicine vial. An adapter flange forms an anchor for a conventional Luer Lock and a receiving receptacle for a conventional slip tip syringe. The bottom end of the receiving receptacle is capped with a cylindrical sieve providing multiple fluid flow paths. An outer optional jacket, surrounding the vial top, is disclosed. Such jacket does not cover the link or the flip-off or twist-off tip inserted into the link.

For the reasons stated above, and for other reasons stated below, there is a need in the art for an improved package, particularly a closure system, for sterile fluids providing an improved functionality wherein the content of the container of the package can easily be transferred to a delivery device such as a syringe or cartridge.

With the package of the invention, the problem is solved by providing an alternative package wherein the stopper is replaced with a connecting plug. The claimed package comprises a container, a connecting plug and a cap. The package hence includes an integrated connection for easily transferring the content of the container of the package to a delivery device.

DETAILED DESCRIPTION OF THE PREFERRED EMBODIMENTS

Figure 1:
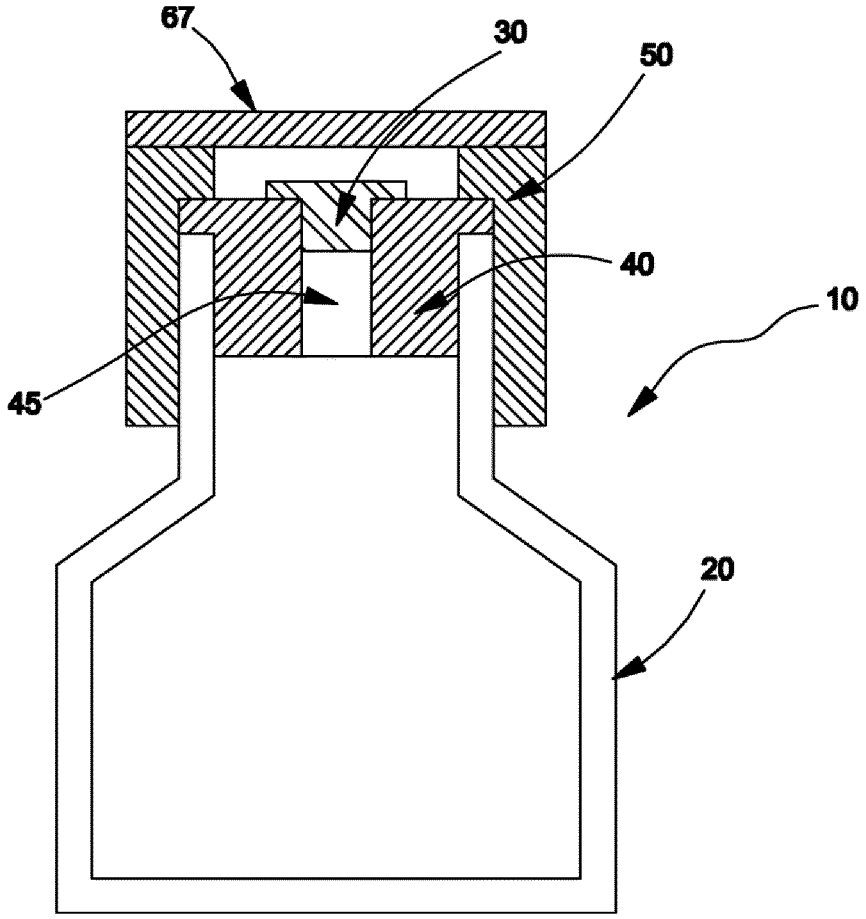
FIG. 1 schematically shows the package of the invention comprising a container, a connecting plug, a plug seal and a cap.

The applicant has identified a package with improved functionality. The combination of the package, including a connecting plug, provides the functionality that the package can be opened in several ways. As with known packages, e.g. as described in WO00/03920 mentioned above, the package still has the possibility to be opened completely by removing the cap and the connecting plug for pouring out the content or for siphoning this with a straw or quill by an injector or other syringe. Alternatively, with the use of the connection plug the package can easily be connected with a variety of delivery devices for transferring the content of the container. With the package of the invention, there is no need for a needle or other sharp objects to penetrate the closure of the package. Further, there is no need for any adaptors, links or transfer sets for transferring the liquid from the container to another container as the package includes an integrated connecting plug.

The new package is easy to open, it includes tamper-evident features to ensure it is not opened and used more than once, and it includes features ensuring the sterile liquid filled in it is kept sterile.

Hence in a first aspect, the present invention provides a package comprising a) a container with a mouth, b) a connecting plug removably inserted into said mouth, comprising a centrally located passageway extending through the plug body, the passageway having a first opening and second opening, c) a plug seal removably inserted into the first opening of the passageway of the connecting plug, d) a cap overlying said connecting plug and plug seal comprising a removable portion which can be removed to gain access to said connecting plug and plug seal.

The connecting plug, and its belonging plug seal, is herein named a combined plug. The combined plug and the cap define a closure system for the container.

The Container:

The container of the package of the invention may be a bottle or a vial and is preferably a bottle. The container may be formed of glass or plastic, such as clear or opaque plastic, and may be either a rigid or flexible plastic container. The size of the container is e.g. from 3 ml to 50 000 ml, e.g. such as from 3-500 ml.

The Connecting Plug:

The functionality of the combined plug is that it both seals the container and can function as a connector between the container of the package and a delivery device. Preferably, the connecting plug provides one part of a Luer taper connection, and this connecting plug can be connected with another part of a Luer connection such as on a delivery device, providing Luer capability.

The connecting plug will generally be formed of an elastic material such as from plastics or elastomers, such as selected from thermoplastic polymer and from rubber, or from a combination of plastics and rubber. In one embodiment the plug comprises a coating to improve the ability to provide a tight seal between the inside of the container mouth opening and the plug, i.e. on the outer surface of the cylindrical body of the plug, when the plug is inserted into the mouth.

The connecting plug has a generally cylindrical body and the radius of the body is slightly greater than the radius of the inner surface of the neck of the container. Hence, the body of the connecting plug is configured so as there is an interference fit between this and the neck of the container. The plug thus seals the container when the plug seal is positioned in the first opening of the passageway of the connecting plug, and the plug is positioned in the mouth of the container.

In one embodiment, the upper surface of the body of the connecting plug is substantially planar, with the first opening of the passageway forming a centrally located aperture in the upper planar surface of the body. The plunger body defines the first opening and the second opening, the body comprising the passageway extending in fluid communication between the first and second openings. In another embodiment, a protruding section extends from the upper surface of the body of the connecting plug, wherein the centrally located passageway is located inside the protruding section and going throughout the body of the connecting plug. The top surface of the protruding section defines the first opening and the plunger body defines the second opening, the passageway extending in fluid communication between the first and the second openings. The protruding section is preferably an upstanding annular portion surrounded by an annular recess. In such embodiment the annular recess forms one portion of the upper surface of the body of the plug. The top surface of the protruding section, and hence the first opening, may substantially flush with an upper surface of a flange of the body of the connecting plug, or alternatively the top surface of the protruding section is either positioned lower or higher than the flange of the connecting plug. The surface of the flange forms another portion of the surface of the body. The passageway and the optional protruding section together form a connecting portion of the connecting plug.

In a preferred embodiment the connecting portion of the connecting plug provides one part of a Luer taper connection. The Luer taper is a standardized system of small-scale fluid fittings used for making leak-free connections between a male-taper fitting and its mating female part. There are two varieties of Luer taper connections: Luer Lock and Luer Slip. Luer Lock fittings are securely joined by means of complementary threads and tabs on the two parts, and the two parts are twisted and locked together. Luer Slip fittings are pressed together and are held together by friction only, without any threads. The connecting portion of the connecting plug is configured such that it provides one part of a Luer taper connection either of the Luer Lock type or the Luer Slip type, or of both. The connecting portion of the connecting plug is configured to function as either the male or the female entity of such connection.

The connecting portion is made suitable for use with either Luer Slip or Luer Lock connection parts of delivery devices. The passageway of the connecting plug is typically tubular or provided with conical geometry. In one embodiment the passageway is configured with conical geometry at first, second or both openings, or between these. If the passageway is frustroconical, the plunger body defines the first opening and the second opening, the body comprising an inwardly-facing frustroconical surface defining the passageway extending in fluid communication between the first and second openings. In the embodiment wherein the connecting portion includes a protruding section surrounding the passageway, the outwardly facing wall of this may be either substantially cylindrical or it has a frustoconical shape, i.e. it is tapered. If the passageway is tubular the outwardly facing wall of the protruding section is preferably tapered, and if the passageway is frustroconical the outwardly facing wall of the protruding section is preferably cylindrical.

The connecting plug of the package of the invention is hence configured to fit with different Luer taper connections. The passageway of the connecting plug is in one embodiment located inside the protruding section, providing the possibilities of either inserting the connecting part of a delivery device inside the passageway or alternatively threading it on the protruding section. The following alternatives for the Luer connection of the connecting plug are hence embraced:

The connecting plug may be configured such as to function as the female entity of the connection. In this alternative, the mating connecting part of the delivery device is inserted into the passageway of the connecting plug. In one embodiment, this female connecting plug is adjusted to fit with a Luer Slip connection, such as a slip-tip of a syringe, such that this can be inserted into the tapered passageway of the connecting plug and the passageway firmly surrounds the Luer Slip, forming a sealing fit. In another embodiment, wherein the passageway is located inside a protruding section, the passageway is alternatively configured to fit with a Luer Lock connection. In this embodiment, the upstanding annular portion preferably comprises a Luer Lock anchor. Such anchor may comprise one or more flanges located at the upper surface of the protruding section, i.e. at the rim of the first opening. In this embodiment, the connecting plug is adapted to fit with a Luer Lock connector of a delivery device, preferably having female taper fittings comprising threads matching the flanges of the upstanding annular portion of the connecting plug, such that this may be threaded into the protruding section, and twisted to securely seal the two parts together.

Alternatively, the connecting plug may be configured such as to function as the male entity of the connection. In this alternative, the passageway is located inside a protruding section, and the protruding section has an outwardly facing wall that has conical shape, i.e. it is tapered. In one embodiment this male connecting plug is adjusted to fit with a female Luer Slip connection such that the protruding section of the connecting plug can be inserted into such connection which will firmly surround the protruding section, forming a sealing fit. In another embodiment, the connecting portion is alternatively adopted to fit with a female Luer Lock connection. In this embodiment, the upstanding annular portion has an outwardly facing wall that is tapered and preferably comprises screw threads. In this embodiment, the connecting plug is adapted to fit with a Luer Lock connector of a delivery device, preferably having female taper fittings comprising flanges matching the screw threads of the upstanding annular portion of the connecting plug, such that this may be threaded on the protruding section, and twisting together securely seal the two parts together.

At the upper end of the body of the connecting plug this comprises, in one preferred embodiment, a flange, and this will rest on the top of the neck of the container mouth when the plug is fully inserted therein.

The connecting plug of the invention can be adopted to fit with various delivery devices, and preferably to any such device comprising a Luer Slip or Luer Lock connection, either of the female or male type. Such delivery devices include, but are not limited to syringes, cartridges and connection tubes.

The Plug Seal:

The package of the invention comprises a plug seal, also called a tip seal, which is adapted to close the first opening of the passageway of the connecting plug. The plug seal comprises one or more sealing portions and a grip portion. To access the connecting plug such plug seal has to be removed. The plug seal is configured to match the connecting portion of the plug to provide a sealing fit. The plug seal is made of a plastic material, optionally elastic. The sealing portion is either adapted to be inserted into the first opening of the passageway of the connecting plug, or it is threaded onto the upstanding annular portion of the connecting plug, or alternatively it is designed such that it is both inserted into the first opening of the passageway and at the same time is threaded on the upstanding annular portion of the connecting plug. If the sealing portion of the plug seal is to be inserted into the passageway of the connecting plug the seal is preferably made of an elastic material to provide optimal sealing. The sealing portion of the plug seal has a Luer connection matching the Luer connectivity of the connecting plug. For these alternatives, the plug seal may be designed to be of the pull-off or twist-off type, hence it may have a taper shape, threads or tabs matching the Luer connectivity of the connecting plug. When the plug seal is removed the Luer opening is protected from contamination due to its preferred location in a recess in the connecting plug.

The Cap:

The package comprises a cap overlying the connecting plug and plug seal. The cap secures the connecting plug in place in the mouth of the container. Preferably, the cap is a screw cap and the container and the cap have complementary screw threads. This provides a simple and effective way of securing the cap on the container and securing the combined plug. It is further preferred that the cap be provided with a tamper-evident feature, to reduce the risk of fluid being administered from a package which has been opened and then reclosed. Such opening and reclosing can result in the fluid losing its sterility, or in adulteration or contamination of the fluid in some form. One suitable form of tamper-evident feature is a member removably attached to the cap, which must be detached from the cap before the cap can be removed from the container. The absence of the member is then a sign that the package has been opened at some time, and should not be used. The cap further comprises an annular skirt extending downwardly from the edge of a cover aperture. Preferably, detachably attached to the lower end of the skirt of the cap there may be a ring functioning as the tamper-evident feature. The ring engages beneath a lip on the neck of the bottle. In order to remove the cap from the bottle, it is first necessary to detach the ring from the cap, and the detached ring makes it clear to the user that the package has been opened.

The cap comprises a removable portion which can be removed to gain access to said connecting plug and plug seal. When such removable portion is removed, or partly removed, the plug seal can also be removed and the connecting plug can be connected to a connecting entity of a delivery devices. The removable portion is non-attachable once removed. The cap comprises a circular cover aperture defining a centrally-located passageway therethrough. The passageway of the cover aperture aligns in overlying registry with the upper surface of the combined plug, i.e. the surface extending from the flange of the body of the plug. Hence, the cap is configured to provide a circular orifice above the upper surface of the combined plug, when the removable portion of the cap is removed. The cover aperture comprises an inner and an outer perimetrical rim, wherein the inner rim defines the circumference edge of the orifice of the cover aperture.

The package of the invention provides different alternatives covered for the removable portion of the cap, and the following removable portions are preferred alternatives: A flip cover, a tear off part and a membrane entity.

In one embodiment, the removable portion of the cap is a removable flip cover which overlies the connecting plug and the plug seal. This removable entity can be removed to gain access to the combined plug. With such a closure system, the closure can be opened in a number of ways. The flip cover can be removed to gain access to the connecting plug and the plug seal, and the plug seal may then be removed. The connecting plug can then be connected with a connecting entity of a delivery device. Alternatively, the combined cap with the flip cover attached can be removed, which then allows access to the entire plug, i.e. connecting plug and plug seal. As a further alternative, the entire cap and the plug can be removed, to enable pouring or the insertion of a quill or straw to load an autoinjector. The flip cover can be removed from the cap without tearing or braking any material, such as a plastic material, in an easy manner, giving access to the plug. At the same time, the flip cover is adapted to tightly fit the rest of the cap reducing the risk of dislocation of the flip cover and ensuring not to contaminate or otherwise adulterate the sterile fluid while the flip cover is in place.

In this embodiment the cap comprises an overlying flip cover as the removable portion. The flip cover overlies the cover aperture and the centrally-located passageway of this. The outer perimetrical rim of the aperture cover defines a cylindrical wall which extends downwardly generally about the periphery of the circular cover aperture. The cap further comprises an annular skirt extending downwardly from the cylindrical wall. The flip cover is a lid for the cover aperture of the cap and is adapted to align in overlying registry with the cover aperture of the cap, and with the combined plug. The flip cover comprises a circular disc overlaying the cover aperture of the cap such that the disc engages with the cover aperture. The flip cover further comprises a periphery wall which extends downwardly about the periphery of the circular planar disc, such this can be engaged with the cylindrical wall of the cap. The circumference of the periphery wall of the flip cover is only slightly larger than the circumference of the cylindrical wall of the cover aperture of the cap. In one embodiment, the circular disc is planar. In another embodiment, the circular disc of the flip cover is formed in such manner that it is not planar, for example by having the central part of the disc projecting above the peripheral region. The reasoning for such design is that packages of sterile fluid are frequently autoclaved to ensure sterility, and it is quite possible for steam from the autoclave to condense on the packages during the cooling phase. The drainage of water can be assisted by forming the circular disc member in such a manner that it is not planar.

It is further preferred that the flip cover be provided with a tamper-evident feature, to reduce the risk of fluid being administered from a package which has been opened and then reclosed. Such opening and reclosing can result in the fluid losing its sterility, or in adulteration or contamination of the fluid in some form. One suitable form of tamper-evident feature is a member that makes it impossible to reattach the flip cover when this has been opened or removed. Hence, in this embodiment the flip cover comprises legs extending downwardly from the circular disc. A leg comprises a first part which is a bar, e.g. an oblong formed bar, extending downwardly from the circular disc. The legs are annularly arranged, preferably regularly spaced. In one embodiment they are positioned perpendicularly to the circular disc, but they may also be attached to the circular disc forming an angel different from 90°. There are preferably 3 to 10 legs. The legs and their position are adapted to fit adjacent to the perimetric inner rim of the cover aperture. In a preferred embodiment, the periphery wall of the flip cover which extends generally about the periphery of the circular planar disc and the annularly arranged legs are in parallel. In a preferred embodiment, the flip cover includes such legs functioning as amper-evident elements, making it possible to see if the flip cover has been opened. If the flip cover has been opened, the legs will be broken, bent or deformed and repositioning them under the cover aperture of the cap will not be possible without unscrewing the cap thereby making it possible to see that the flip cover has been tampered with.

In one embodiment, the ends of the legs, i.e. the ends not being fixed to the circular disc, include slightly bended portions such that the legs better hinge to the perimetric inner rim of the cover aperture. Hence, the bended portion of the legs extends between the upper perimetrical rim of the body of the connecting plug and the underside of the perimetric rim of the cap. When such flip top is positioned on top of the cap, which is overlying the combined plug, the legs of the flip cover secures the flip cover to the cap as the legs will be bent around the edge of the orifice of the cap. When removing the flip cover from the cap, the first part of the legs detach from the cover aperture of the cap. When the flip cover has been removed once, it is impossible to reattach this properly.

In a further embodiment, the flip cover comprises features that ensure that the flip cover is not dislocated unless this cover is purposely opened or removed. A dislocated part of a closure system, such as the flip cover, could be contaminated, and if such non-sterile body comes into a sterile area this could seriously disrupt the process taking place in this area. In this embodiment, the flip cover is provided with two stage legs. Accordingly, the legs extending downwardly from the circular disc comprise a second part. The first part is the bar while the second part is an extended leg comprising a longer elongated bar. Hence, the second part extends further and these two stage legs ensure the flip cover is tightly secured to the cover aperture, and this feature prevents the flip cover becoming dislocated during opening and/or after opening. The extended legs secure the flip cover in place by compression of the second part of the legs between the underside of the cover aperture of the cap and the upper surface of the flange of the body of the connecting plug. When the flip cover, comprising such two stage legs, is positioned on top of the cover aperture of the cap, which overlies the combined plug, the two stage leg preferably extends downwardly from the circular disc and ends at the periphery of the upper surface of the connecting plug, and towards the internal perimeter of the cap. In this embodiment, at least one of the legs extending from the circular disc is a two stage legs. When removing the flip cover from the cap, the first part of a leg detaches from the cover aperture of the cap. With the two stage legs, the flip cover is still held by the second part of the legs, still held in a squeeze between the cover aperture of the cap and the connecting plug. Further removal stretches and pulls the second part of the leg out, restricted only by friction. When the flip cover is lifted well away from the cover aperture of the cap it is easy to grip hold of and securely remove, or alternatively leave it hinged, by one or two of the two stage legs. With these two stage legs it is prevented that the flip cover is dislocated such as falling off during removal. In a preferred embodiment, the flip cover includes such two stage legs providing both a tamper evident function and a feature that prevents the flip cover from becoming dislocated during and/or after opening. In addition to these functions on the flip cover, the cap has, in a particularly preferred embodiment, a tamper-evidencing element detachably attached to the lower end of the skirt of the cap.

The flip cover may in one embodiment include an opening element, making it easier to flip open the flip cover. One example of such opening element is a handle, such as a rounded handle extending from the periphery of the generally circular disc of the flip cover for the purpose of prying open the flip cover. Preferably, such opening element is placed straight across from the at least one two stage leg, directing where the flip cover opens.

Figure 6:
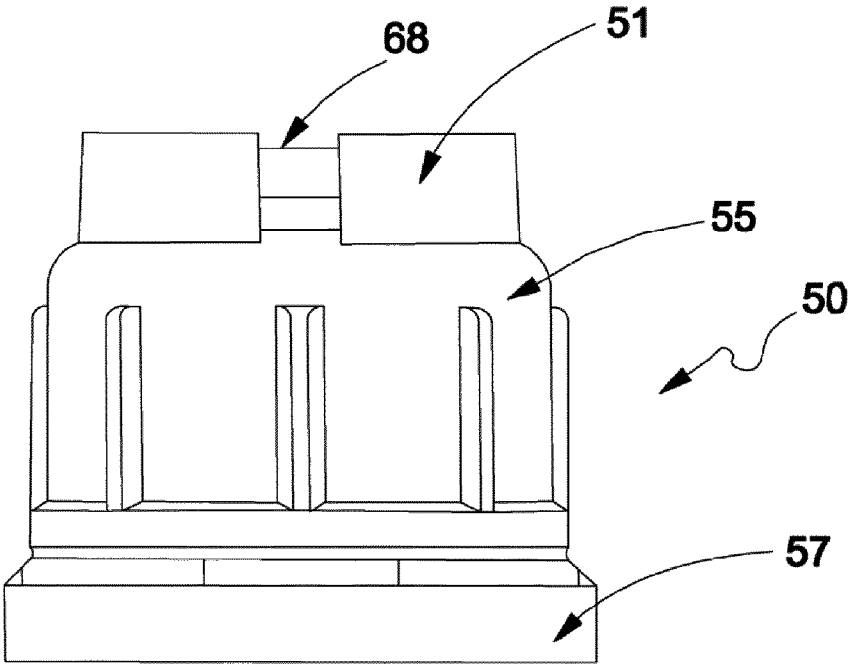
FIGS. 6, 7, 8 and 9 depict alternative caps which may be included in the package of the invention.
Figure 7:
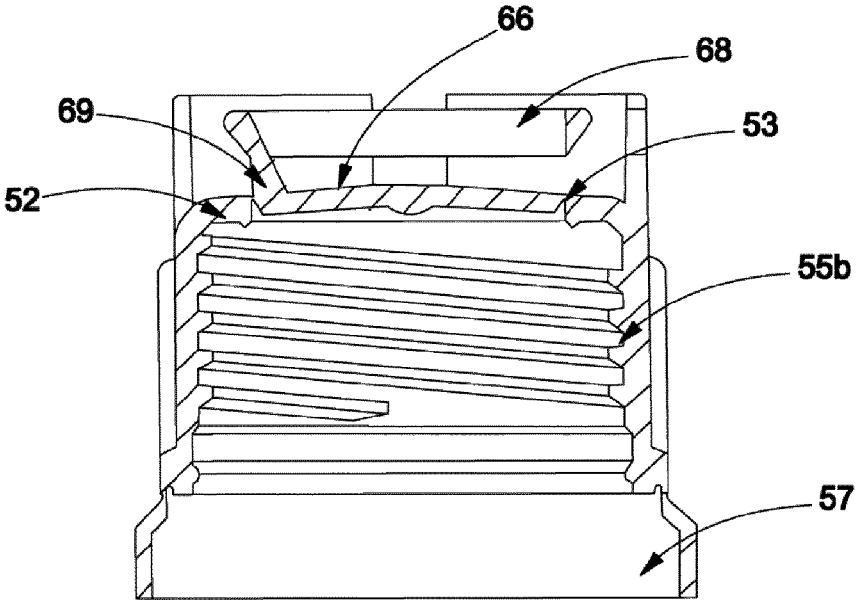

In a second alternative for the removable portion of the cap, the removable portion comprises a tear off part. Hence, in this alternative a portion of the cap is torn off by way of tearing or braking the material of the cap. Such cap has been described in WO00/03920 of the applicant, and is also shown in FIGS. 6 and 7 of the present application. In this embodiment, the removable portion is a region of the cover aperture wherein the upper surface of the cover aperture is formed with a line of weakness around such region, and the line of weakness facilitates the removal. Removal of this region exposes the combined plug, and the plug seal can be removed. In order to allow the removable region to be removed, the cap further comprises en engageable member for operation by a user. The engageable member preferably comprises a ring upwardly spaced from the removable portion. This allows the user of the package to hook a finger beneath the engageable member, and thus makes it easier to operate. The cap further preferably comprises an annular wall projecting upwardly from the edge of the cover aperture, whose circumference matches that of the cover aperture. The wall protects the engageable member from accidental operation or entanglement. The wall may be formed with a number of openings to allow any liquid on top of the cover aperture to drain away.

In yet another alternative for the cap, the removable portion comprises a removable membrane entity. The membrane is preferably frangible so that it can be torn off, thereby exposing the combined plug. The membrane is preferably directly attached to the cover aperture, such that a part of the lower surface of the membrane is directly attached to the upper surface of the cover aperture, preferably at least at the periphery of this. The membrane may be attached to the cover aperture in different ways, such as being glued or fixed to this. Such entity preferably comprises a planar circular membrane. The membrane is preferably made of a polymer and is optionally transparent. The membrane entity may in one embodiment include an opening element, making it easier to grip and tear this off. One example of such opening element is a rounded handle extending from the periphery of the generally circular disc of the membrane entity. In another embodiment such opening element comprises a connecting portion overlying the membrane of the membrane entity. Further, such opening element preferably has a circular periphery, preferably matching the circumference of the membrane. In a particularly preferred embodiment, the membrane comprises a planar circular membrane disc, and attached to the surface of this is an opening element having an outer rim provided with protrusions. Corresponding with these protrusions there are similar protrusions on the perimetric inner rim of the cover aperture of the cap. The protrusions of the connecting portion are fixed to the membrane and are in close vicinity of each other. The design concentrates the stress when the opening element is manipulated to remove the membrane and thereby reducing the required force needed.

In a further embodiment of the invention, the package comprises a venting passage to allow inlet of air into the container when liquid is removed from the container. The need for such venting is more relevant for smaller containers, and also for container made of less flexible materials. In one alternative, the connecting plug includes a separate additional passageway for such venting extending through the body of the connecting plug. A removable seal is attached to an upper opening of such passageway. In another alternative, the container body comprises a venting passage, suitably capped. In a third alternative, the venting passage is associated with the passageway of the connecting plug. Preferably, in this alternative, one or more venting passages extend alongside the passageway of the connecting plug allowing inlet of air between e.g. a syringe tip inserted into the connecting plug, and the inner wall of the passageway of the connecting plug.

The package of the invention may be filled with any liquids, but is preferably for use with a sterile liquid, such as a pharmaceutical composition. Most preferably, the package is for use with a contrast media. In one embodiment, the bottle of the package is filled with such sterile liquid.

Preferred embodiments of the invention will now be described by way of example only and with reference to the accompanying drawings, in which FIG. 1 schematically shows the package 10 of the invention comprising a container 20, a connecting plug 40 inserted into the mouth of the container, a plug seal 30 inserted into a passageway 45 of the connecting plug, and an overlying cap 50, comprising a removable portion 67.

Figure 2:
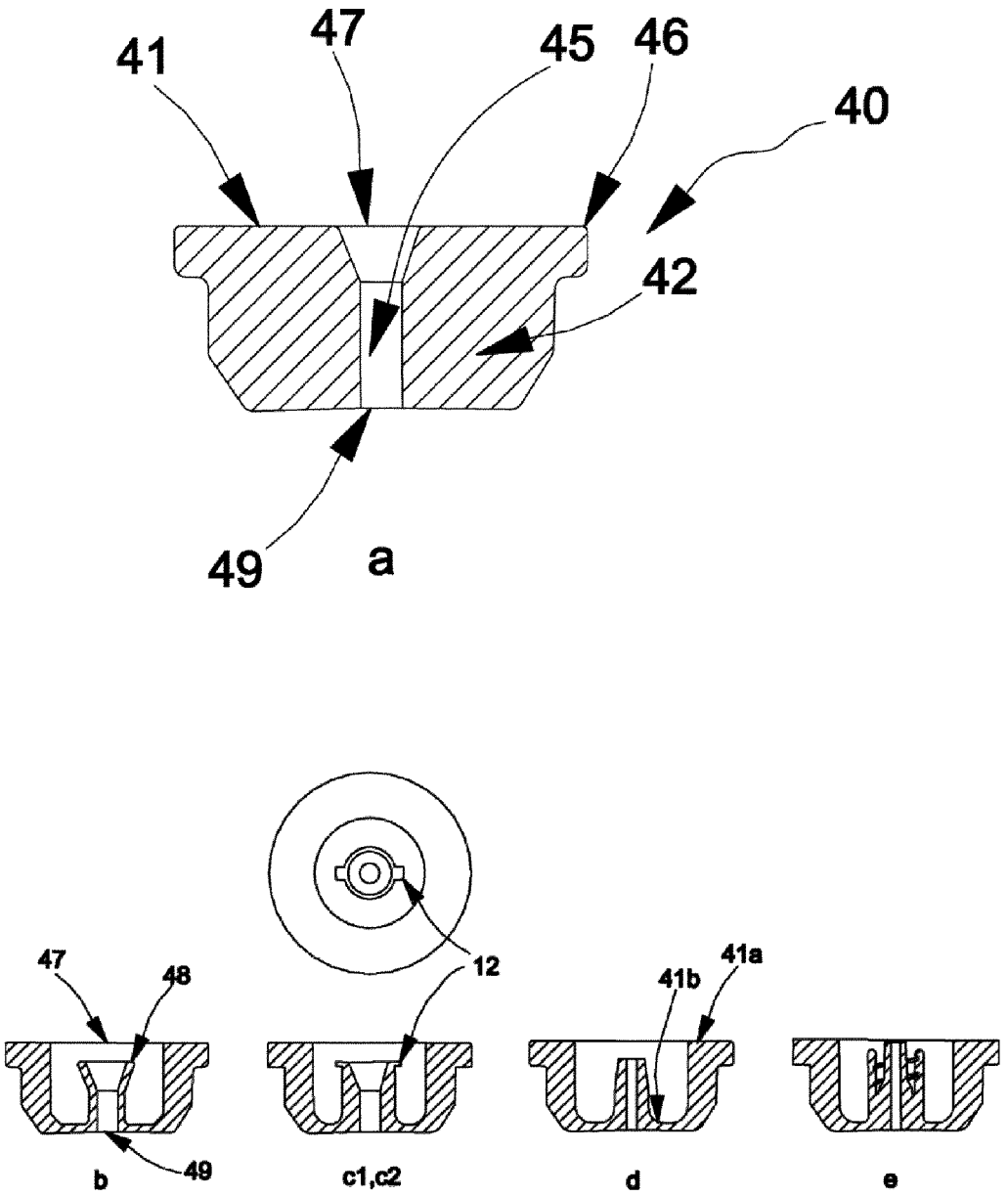
FIG. 2 depicts alternative connecting plugs.

FIGS. 2*a-d* show alternative connecting plugs. The connecting plug 40 has a generally cylindrical body 42, and the radius of the body is slightly greater than the radius of the inner surface of the neck of the bottle. This allows the body 42 of the connecting plug 40 to be an interference fit in the neck of a bottle. The body has at the periphery a flange 46. The flange 46 will rest on the top of the neck of the bottle when the connecting plug 40 is fully inserted therein. Alternative connecting plugs are shown in FIGS. 2*a-e*, wherein 2*b-e* have different protruding portions 48. The connecting portion of FIG. 2*a* has a planar upper surface 41 extending between the periphery of the flanges, and wherein the passageway 45 extends in fluid communication between a first opening 47 and a second opening 49. FIG. 2*b* shows a female Luer Slip connection, FIG. 2*c*1 shows a female Luer Lock connection, wherein FIG. 2*c*2 shows the cross section of this connection showing a pair of flanges 12. FIGS. 2*d* and 2*e* show male Luer connections, of the Slip type and Lock type, respectively. In the embodiments shown in FIGS. 2*b-e* the upper surface 41 includes one portion 41*a* being the surface of the flanges and a second portion 41*b* being the body surface in the recess.

Figure 3:
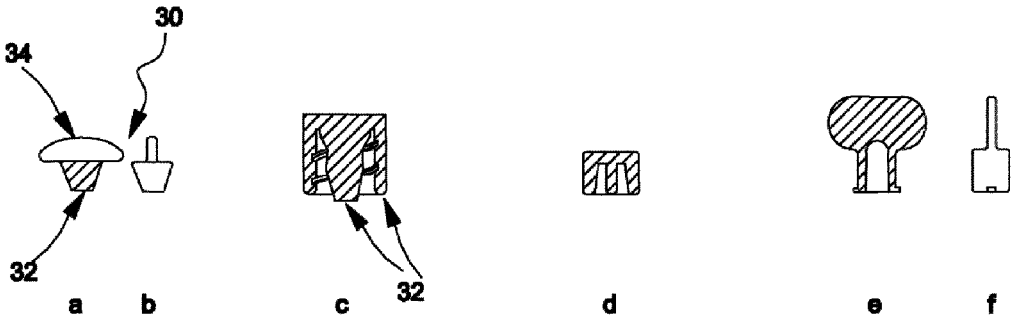
FIG. 3 depicts alternative plug seals.

FIG. 3(*a, c-f*) shows alternative plug seals matching the connecting plugs of FIG. 2. FIG. 3*b* shows the same plug seal as FIG. 3*a*, but seen from another perspective. When a plug seal 30 is attached to or into the protruding portion 48 of the connecting plug this is sealed. FIGS. 3*e* and 3*f* show a plug seal fitting the plug of FIG. 2*e*. The plug seal 30 generally comprises sealing portion(s) 32 and a grip portion 34, wherein the sealing portion matches the Luer connectivity of the belonging connecting plug.

Figure 4:
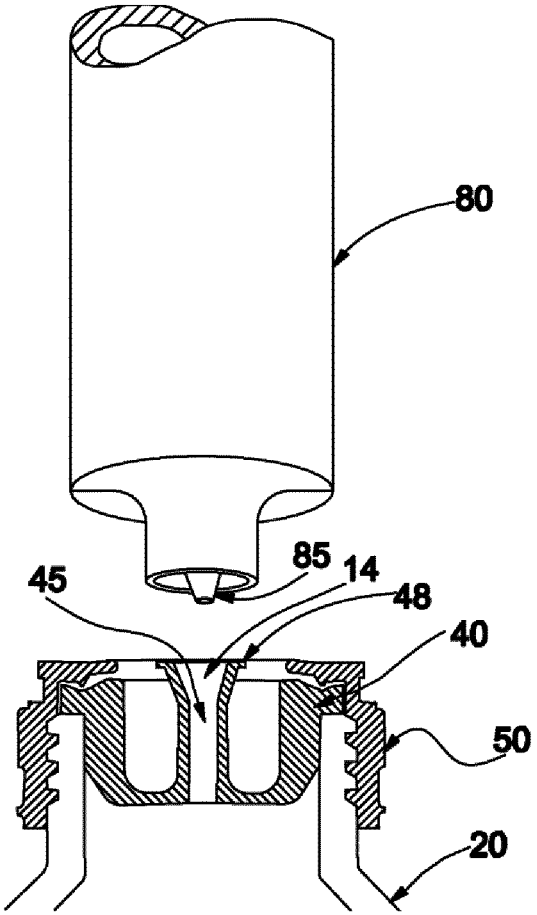
FIG. 4 depicts a package of the invention wherein the connecting plug is being connected with a syringe.

FIG. 4 shows part of a package 10 of the invention wherein the removable portion 67 of the cap 50 has been removed. Further, the plug seal 30 has been removed, and a syringe 80 with a Luer tip 85 is to be connected to the connecting portion 14, i.e. to the passageway 45 and the protruding portion 48, of the connecting plug 40, by inserting the syringe tip 85 into the passageway 45 of the protruding portion 48 and securing this by the luer lock.

Figure 5:
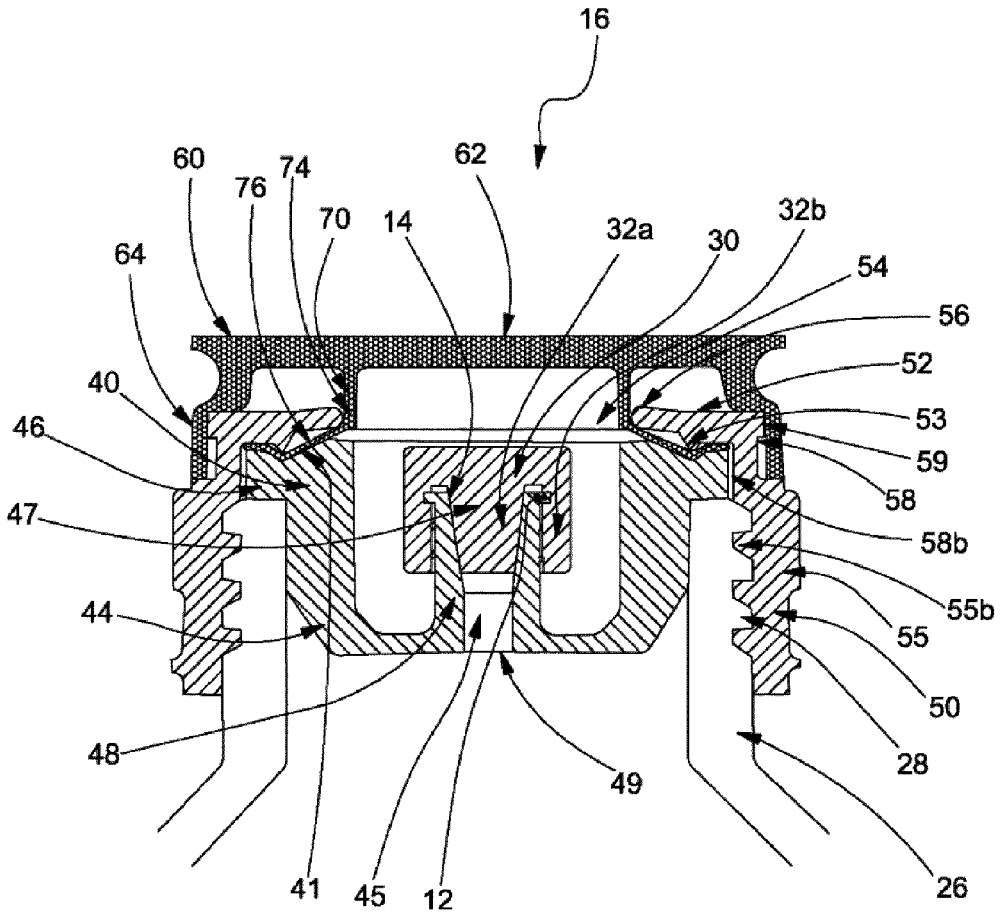
FIG. 5 depicts the closer system of a package of the invention wherein the cap includes a flip cover.

FIG. 5 shows a preferred embodiment of the invention, showing the closure system 16 of the package 10, comprising a cap 50, a connecting plug 40 and a plug seal 30. The cap 50 is attached to the upper part of the neck 26 of the bottle. The cap has a cover aperture 52 which overlies the connecting plug 40, and an annular skirt 55 extending downwardly from the edge of the cover. The cover aperture comprises a perimetric inner rim 56 defining the circumference edge of the orifice 54, i.e. the passageway, of the cover aperture. The cover aperture further comprises an outwardly facing cylindrical wall 58 extending about the perimetric outer rim 59 of the cover aperture, projecting downwardly from the rim. In this example, the underside of the cover aperture 52 further includes an annular member 53 extending downwardly from it. The lower end of the annular member engages with the upper surface of the connecting plug and helps to ensure the integrity of the closure system 16. In addition, the annular member 53 surrounds a central region of the upper surface of the connecting plug, and helps to prevent contamination of it. The skirt 55 has an internal screw thread 55*b* formed on its inner surface, which engages with the external screw thread 28 formed on the neck 26 of the bottle to retain the closure in place.

In the example of FIG. 5, the removable portion of the cap 50 is a flip cover 60. The flip cover 60 includes a planar circular disc 62 and a periphery wall 64 extending downwardly around the circular disc, whose circumference matches that of the circular disc. The circular disc 62 overlays the cover aperture 52, including the orifice 54, of the cap 50 such that the circular disc 62 engages with the cover aperture, which overlies the connecting plug 40. The periphery wall 64 of the flip cover is engaged with the cylindrical wall 58 of the cap 50.

Further in FIG. 5 the connecting plug 40 is positioned in the mouth of the bottle. The lower end of the body 42 has a chamfer 44, to aid insertion of the body 42 into the neck of a bottle 20. The body of the plug 40 has a flange 46 resting on the top of the neck of the bottle. The connecting portion 14 of the connecting plug includes a protruding portion 48 circumventing the passageway 45 having a first opening 47 and a second opening 49. The passageway 45 has a conical geometry as the first opening, and at the rim of the first opening two oppositely placed flanges 12 are located, such that the connecting portion forms a female Luer Lock connection. Attached to the connecting portion 14 of the plug 40 is a plug seal 30. A sealing portion 32*a* is inserted into the passageway of the connecting plug, while another portion 32*b* embraces the protruding portion 48.

Further in FIG. 5, extending downwardly from the underside of the circular disc 62 of the flip cover 60 a set of legs 70 is located. The two stage legs are, before assembly of the cap, extending outwardly from the circular disc and are annularly arranged. The legs are positioned annularly adjacent to the perimetric inner rim 56 of the cover aperture 52. In this embodiment, a leg includes a first part 74 extending downwardly from the circular disc, and a second part 76 which is an extension of the leg ending at the periphery of the upper surface 43 of the connecting plug, and towards the internal perimeter 58*a* of the cap. The two stage legs 70 extending from the underside of circular disc 62 of the flip cover towards the internal perimeter 58*b* of the cap are forced tightly between the upper surface 41 of the connecting plug 40 and the underside of the cover aperture, bended over the annular member 53 of the cover aperture of the cap.

FIGS. 6 and 7 show one example of a cap 50 of the package 10 of the invention. The cap has a cover aperture 52 which overlies the connecting plug, and an annular skirt 55 extending downwardly from the edge of the cover aperture 52. The skirt 55 has an internal screw thread 55*b* formed on its inner surface. Detachably attached to the lower end of the skirt 55 is a ring 57 which will engage beneath a lip on the neck of a bottle, serving as a tamper-evidencing element. Such element would preferably also be included on the cap of the package shown in FIG. 5. Projecting upwardly from the edge of the cover aperture 52 is a generally annular wall 51, formed with a number of openings. The upper surface of the cover aperture is formed with a line of weakness 53 around a region 66. The line of weakness facilitates the removal of the region 66, allowing exposure of the combined plug. A pull-ring 68 is attached to the region 66 by way of legs 69 so a user's finger can grab this and tear off the removable portion, the region 66.

Figure 8:
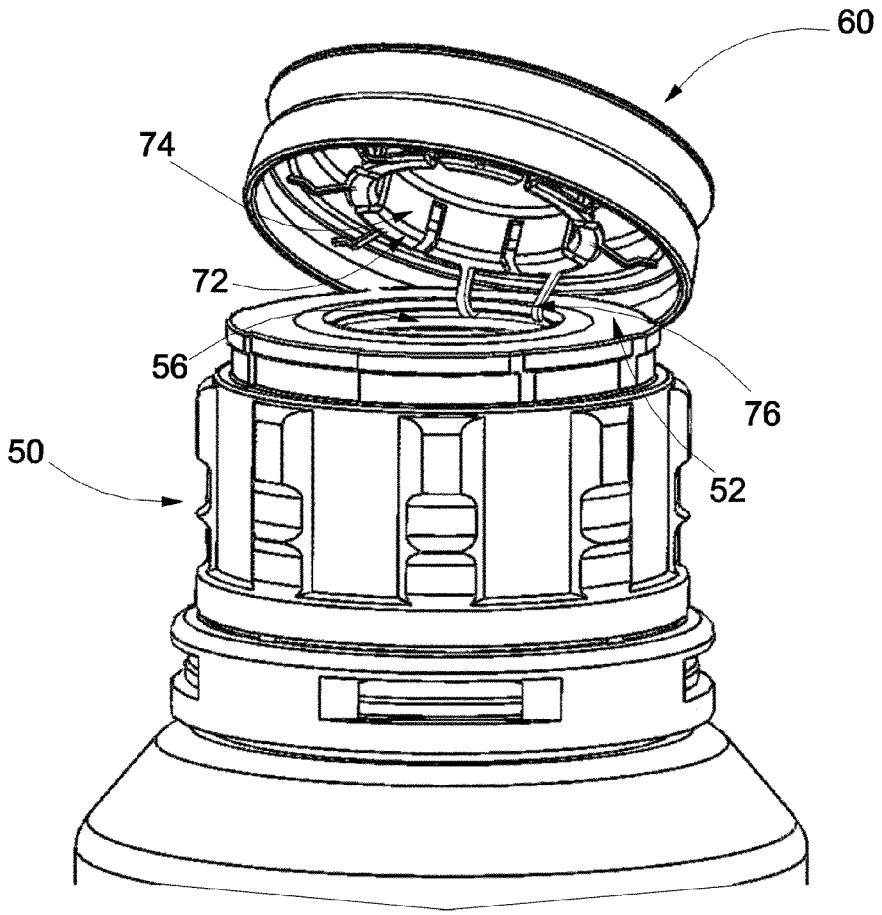

FIG. 8 shows the cap 50 wherein the removable portion is a flip cover 60, wherein the flip cover has been opened, but is still attached. At the end of the first part 74 of a leg 70 a bended portion 72 is included which is now loosen from the perimetric inner rim 56 of the cover aperture 52, while the second part 76 still hinges under the perimetric inner rim 56 of the cover aperture 52 and towards the internal perimeter 51 of the cap.

Figure 9:
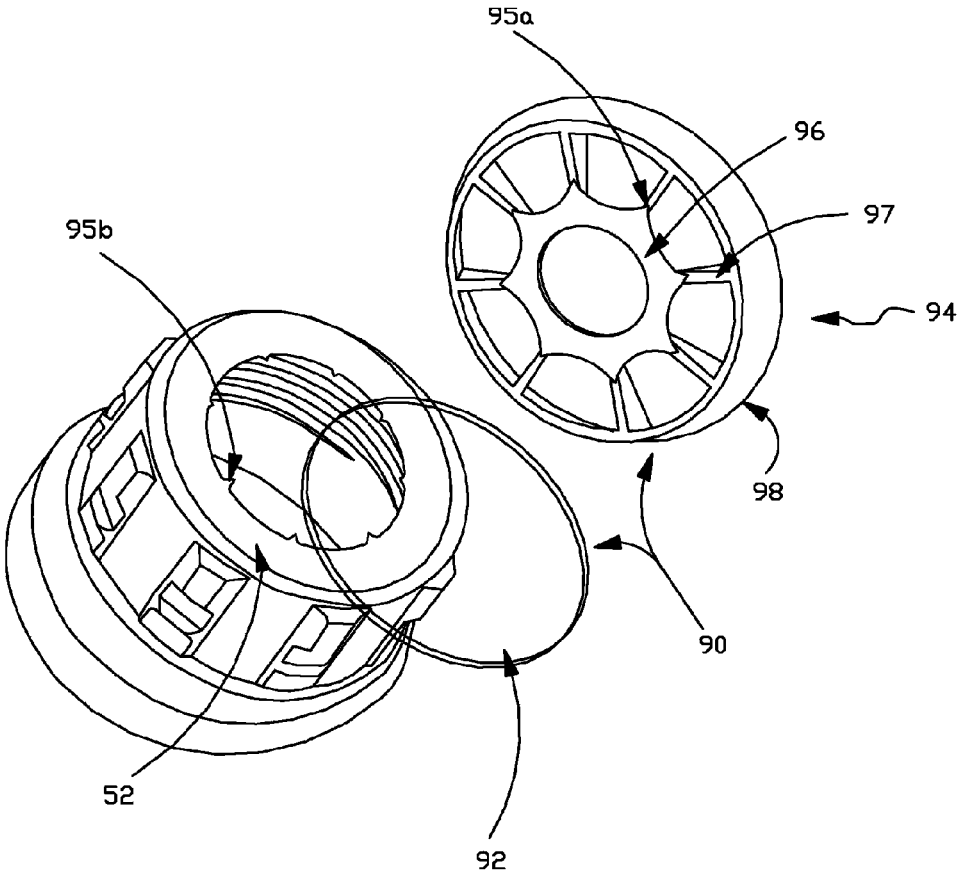

FIG. 9 shows an alternative of the cap of the claimed package. In this embodiment, the removable portion comprises a membrane entity 90 comprising a planar circular disc membrane 92 overlying the cover aperture 52 of the cap. The membrane 92 is directly attached to the cover aperture 52. The membrane entity 90 further includes an opening element 94, making it easier to grip and tear this off. In this embodiment, the opening element 94 comprises a connecting portion 96, with protrusions 95*a*, which are attached to the membrane disc 92 of the membrane entity 90, having a circular periphery also proficed with protrusions 95*b* in the near vicinity of the first mentioned protrusions 95*a* and a rim 98 for manipulating the rim which also matches the circumference of the membrane disc 92. The protrusions 95*a* concentrate the stress on the membrane to ease tearing when manipulating the circumferential rim 98. Further, the connecting portion 96 comprises an open framework 97 bound together by the outer rim 98. Removal of the membrane entity 90 from the cap 50 would expose the upper surface of the connecting plug 40 and the plug seal 30.

The invention claimed is:

1. A package comprising a) a container with a mouth, b) a connecting plug removably inserted into said mouth, comprising a plug body and a centrally located passageway extending through the plug body, the passageway comprising a first opening and second opening, c) a plug seal to be removably inserted into the first opening of the passageway of the connecting plug, d) a cap overlying the connecting plug and the plug seal, the cap comprising a cover aperture and a removable flip cover which can be removed to gain access to the connecting plug and the plug seal, wherein said removable flip cover comprises a circular disc overlaying the cover aperture of the cap and a plurality of legs, each of the plurality of legs comprising a first part extending downwardly from the circular disc and a second part extending from the first part, wherein at least one second part of at least one of the plurality of legs extends between an underside of the cover aperture and an upper surface of the connecting plug to prevent the flip cover from being dislocated from the package after opening.

2. The package as claimed in claim 1, wherein the connecting plug is one part of a Luer taper connection.

3. The package as claimed in claim 1, wherein the connecting plug is a male or a female entity of a Luer Slip or Luer Lock connection.

4. The package as claimed in claim 1, wherein the passageway of the connecting plug is either tubular or provided with a conical geometry at the first, second or both openings, or between these openings.

5. The package as claimed in claim 1, wherein a protruding section extends from the upper surface of the plug body, wherein the centrally located passageway is located inside the protruding section and going throughout the plug body.

6. The package as claimed in claim 1, wherein the plug seal comprises a sealing portion comprising Luer connectivity that matches a Luer connectivity of the connecting plug.

7. The package as claimed in claim 1, wherein the connecting plug further comprises a venting passage to allow inlet of air into the container of the package when a liquid is removed from the container.

8. The package as claimed in claim 1, wherein the container is filled with a sterile liquid.

9. The package as claimed in claim 1, wherein the cover aperture overlays an upper perimertic rim of the plug body.

10. The package as claimed in claim 1, wherein the centrally located passageway aligns in overlying registry with an upper perimetric rim of the plug body.

11. The package as claimed in claim 1, wherein the second part of at least one of the plurality of legs extends between an underside of the cover aperture and an upper perimetric rim of the plug body.

12. The package as claimed in claim 1, wherein the second part of at least one of the plurality of legs secures the flip cover to the cover aperture based on the second part of at least one of the plurality of legs being under compression between the underside of the cover aperture and an upper perimetric rim of the plug body.

13. The package as claimed in claim 1, wherein the second part of at least one of the plurality of legs is arranged to deform or break based on a hinge between the second part of the legs and an inner perimetric rim of the cover aperture, being dislocated by the removable flip cover.

14. The package as claimed in claim 1, wherein the second part of at least one of the plurality of legs extends towards an internal perimeter of the cap.

15. A package comprising:

a) a container with a mouth, b) a connecting plug removably inserted into said mouth, the connecting plug comprising a plug body and a centrally located passageway extending through the plug body, the passageway comprising a first opening and second opening, c) a cap overlying the connecting plug, the cap comprising a cover aperture and a flip cover which can be moved from a first position to a second position to gain access to the connecting plug, wherein the flip cover comprises a circular disc overlaying the cover aperture of the cap and a plurality of legs, each of the plurality of legs comprising a first part extending downwardly from the circular disc and a second part extending from the first part, wherein the plurality of legs are in:

the first position when the flip cover is positioned on top of the cover aperture of the cap, wherein for each of the plurality of legs the first part of the leg remains extending downwardly from the circular disc and the second part of the leg extends towards an internal perimeter of the cap, and the second position when the flip cover provides access to the connecting plug, wherein the first part of at least one of the plurality of legs detaches from the cover aperture and at least one second part of the at least one of the plurality of legs remains between the cover aperture of the cap and the connecting plug to prevent the flip cover from being dislocated from the package.

16. The package as claimed in claim 15, further comprising a plug seal to be removably inserted into the first opening of the passageway of the connecting plug.

17. The package as claimed in claim 15, wherein the connecting plug is one part of a Luer taper connection.

18. The package as claimed in claim 15, wherein the connecting plug is a male or a female entity of a Luer Slip or Luer Lock connection.

19. A package comprising:

a) a container with a mouth, b) a connecting plug removably inserted into said mouth, the connecting plug comprising a plug body and a centrally located passageway extending through the plug body, the passageway comprising a first opening and a second opening, c) a cap overlying the connecting plug, the cap comprising a cover aperture and a removable flip cover which can be removed to gain access to the connecting plug, wherein said removable flip cover comprises a circular disc overlaying the cover aperture of the cap and a plurality of legs, each of the plurality of legs comprising a first part extending downwardly from the circular disc and a second part extending from the first part, wherein the second part of at least one of the plurality of legs extends between an underside of the cover aperture and an upper surface of the connecting plug and extends to an internal perimeter of the cap.

20. A package comprising:

a) a container with a mouth, b) a connecting plug removably inserted into said mouth, the connecting plug comprising a plug body and a centrally located passageway extending through the plug body, the passageway comprising a first opening and a second opening, c) a cap overlying the connecting plug, the cap comprising a cover aperture and a removable flip cover which can be removed to gain access to the connecting plug, wherein said removable flip cover comprises a circular disc overlaying the cover aperture of the cap and a plurality of legs, each of the plurality of legs comprising a first part extending downwardly from the circular disc and a second part extending from the first part, wherein at least one second part of at least one of the plurality of legs extends between an underside of the cover aperture and an upper surface of the connecting plug to prevent the flip cover from being dislocated from the package after opening.

21. The package as claimed in claim 20, wherein the connecting plug is one part of a Luer taper connection.

22. The package as claimed in claim 20, wherein the connecting plug is a male or a female entity of a Luer Slip or Luer Lock connection.

* * * * *